US005901452A

United States Patent [19]

Clarkson

[11] Patent Number: 5,901,452

[45] Date of Patent: May 11, 1999

[54] GUNSIGHT

[75] Inventor: Andrew R. Clarkson, Pittsburgh, Pa.

[73] Assignee: Remington Arms Co., Inc.

[21] Appl. No.: 08/921,437

[22] Filed: Aug. 29, 1997

[51] Int. Cl.[6] ..... F41G 1/32

[52] U.S. Cl. ..... 33/241; 42/100

[58] Field of Search ..... 33/241; 42/100

[56] References Cited

U.S. PATENT DOCUMENTS

| | | | |
|---|---|---|---|
| 3,216,308 | 11/1965 | Northcutt | 88/1 |
| 3,423,155 | 1/1969 | Herrick et al. | 356/252 |
| 3,992,782 | 11/1976 | Rickert | 356/252 |
| 4,012,150 | 3/1977 | Upatnieks | 356/247 |
| 4,665,622 | 5/1987 | Idan | 33/241 |
| 4,720,291 | 1/1988 | London | 55/227 |
| 4,730,912 | 3/1988 | Loy et al. | 350/503 |
| 4,934,086 | 6/1990 | Houde-Walter | 42/103 |
| 5,044,748 | 9/1991 | Scott et al. | 33/241 |
| 5,068,969 | 12/1991 | Siebert | 33/241 |
| 5,175,651 | 12/1992 | Marron et al. | 359/721 |
| 5,279,061 | 1/1994 | Betz et al. | 42/103 |
| 5,355,224 | 10/1994 | Wallace | 359/631 |
| 5,369,888 | 12/1994 | Kay et al. | 33/241 |
| 5,373,644 | 12/1994 | DePaoli | 33/241 |
| 5,383,278 | 1/1995 | Kay | 33/265 |
| 5,483,362 | 1/1996 | Tai et al. | 359/1 |
| 5,509,226 | 4/1996 | Houde-Walter | 42/103 |

OTHER PUBLICATIONS

"MicroVision Computer Goes Screen–Free" article by Elizabeth Weise, source and date unknown.

C–More Systems, Railway Sight Instruction Manual believed to be prior art.

The Elbit Combat Falcon Optical Gunsight Mark III, Elbit Computers Ltd., believed to be prior art.

*American Rifleman*, pp. 38–41 and 60–62, Oct. 1996.

James Defense Small Arms,1994–1995, Sighting Equipment, pp. 644, 652–653, 657,660–662.

*Primary Examiner*—Charles T. Jordan
*Assistant Examiner*—Denise J. Buckley
*Attorney, Agent, or Firm*—Rhodes, Coats & Bennett, L.L.P.

[57] ABSTRACT

A sight for a gun includes a transparent, substantially cubic, glass body having a front, a rear, and peripheral surfaces including a top, a bottom, a right side and a left side which are opaque and matte. A semi-reflective surface within the body extends from the top to the bottom at a diagonal to the front. Light from a light emitting diode and reticle negative on a the bottom surface is collimated by a collimating mirror with an F/# between 0.6 and 2.0 and reticle negative on the top surface. Light from a target may pass through the front of the transparent body and exit the rear, and light from the light source may be imaged by the reticle negative, pass through the semi-reflective mirror, be reflected and collimated by the collimating mirror and reflected out of the rear by the semi-reflective mirror as an aimpoint pattern that intermixes with light from the target and the light source. The reticle negative and collimating mirror cooperate to make an aimpoint pattern comprising a 30' arc-minute diameter ring having a 4' arc-minute line width focussed at infinity.

49 Claims, 3 Drawing Sheets

GUNSIGHT

BACKGROUND OF THE INVENTION

The present invention relates to a "Heads-Up Display" sighting system, called a HUD for use on shotguns, rifles and pistols, preferably for the shotgun target market such as skeet, sporting clays, and trap. A HUD and reflex sight are similar products in that the scene is not reimaged by the optics and that the sight magnification is 1X unity.

In target shooting such as skeet and the like, the moving target is not a target for very long. The shooter must react to his initial vision of the target, bring the gun to a sighting position, locate the target in the sight, fine-tune the aim of the gun on the target through the sight, and fire. These activities must take place in time frames of a second or less. One of the most critical of these activities is target acquisition within the sight. That is, it is not enough merely for the shooter to see the target and "shoot from the hip." Reliable accuracy requires actually finding the target within the gunsight or scope. This is called "target acquisition."

Thus, it is important to minimize the time or maximize the speed with which the target can be acquired within the sight. The quicker this can be done, the quicker the later steps of actually refining the aim and pulling the trigger can be accomplished.

The number of reflex sight models (1X unity power) available in the market has doubled since 1992. As a general trend, the newer models have larger aperture diameters to accommodate less critical eye alignment and give a larger scene field of view. The early models were packaged in 1 inch and 30 mm tubes, which required scope rings for mounting. Newer models with larger tubes and tubeless designs usually have a mounting system integral to the sight. The early model aimpoints were always red dots of 3 to 6 arc minutes in diameter. Since the competition handgun market is responsible for most of the current development with reflex sights, aimpoint sizes and features have been optimized for handguns and their targets.

The HUD or reflex sight is made up of an optical collimating reflector, mechanical adjustments and packaging, and an electronic light source. Conventional optical methods for collimating and reflecting the aimpoint to the eye use very basic classical optics. The reflex sights are one or two element off-axis reflectors with cover windows to zero the optical power of the scene (near unity 1X magnification) and/or provide environmental seals. To combine the aimpoint wavefront with the scene, the typical reflex sight uses a partially mirrored coating or, for more efficiency, a multilayer dielectric dichroic coating, which reflects only the deep red aimpoint and transmits the visible spectrum of the scene. The hologram relies on diffraction to bring the red aimpoint into the scene.

Glass is the optical material of choice for most sights. Reflex designs are simple reflectors which have a small optical element volume. For this reason the durability and optical properties of glass offset the potential benefits of plastic. Plastic is light weight, moldable for easy aspheric surface production, and cost effective. But plastic's thermal stability, durability, and optical properties are inferior to glass. Other than the holographic sight, reflex optical designs have been traditional and not employed the benefits of aspheres, gradient index glass, and the many types of diffractive optics. Cost versus the design performance advantages usually controls these variables.

The adjustments for aligning the aimpoint axis to the firearm for windage and elevation are usually implemented by precision mechanics, such as are shown in U.S. Pat. No. 5,369,888 to Kay et al., the entire disclosure of which is incorporated herein by reference. A reflex sight design can change the point of impact by adjusting any one of the following, tilting the reflector, decentering the reflector, or decentering the aimpoint source. For the hologram sight only tilt of the holographic window steers the aimpoint. A tilt of the entire assembly is common to all sights. Aluminum is the standard packaging material for most sights. Recently, there have been a few products that have used composites and plastics to reduce weight and cost. Some of these materials have less dimensional stability than aluminum and require the packaging design to be more thorough for collimation and alignment retention over the operating conditions.

The light emitting diode, LED, is the most common light source used in the battery powered sights for its power efficiency and high brightness properties. The typical red dot aimpoint is created by the LED projecting light over a fan angle through a pinhole in an opaque material such as metal or coated glass. The pinhole has a specific size and uniformity so when magnified by the collimating optics, it has the desired angular subtense to overlay with the see-through scene. The aimpoint can be more than a simple dot. Complex reticles can be photo etched onto a glass substrate and can have different gray levels. The only restriction is that larger reticles require the optical design aberrations to be corrected over the field of view of the reticle. Most sights on the market use deep red 670 nm wavelength LED's. The reasons for this are that red LEDs are usually the brightest, red has good color contrast with a green scene, and that the optical reflector coatings can efficiently reflect red without disturbing the transmission efficiency of the scene since the 670 nm LED is near the edge of the visible spectrum (400–700 nm). The holographic sight uses a 670 nm diode laser as a high brightness monochromatic source to illuminate the hologram. The battery sources are typically lithium, silver oxide, and alkaline. Aimpoint brightness is controlled by 10 to 15 position variable resistors or rheostats that usually reduce the brightness by a factor of two between positions.

Holographic sights have the greatest advantage for target acquisition, because they have open apertures which can be located closer to the eye than other sights. The hologram design permits the aimpoint light source to illuminate the holographic window from the front so the light source does not have to be between the combiner and the eye. As a result, the entire sight can be moved closer to the eye within 100 mm (4 inch) or to the minimum safe eye distance.

There is a relationship between the size of the aperture and the focal length of the reflector, which is roughly the distance to the LED point source. The name for this optical parameter is F-number (F#), which is the focal length divided by the aperture diameter in equivalent units. As the F# gets below three, the relative power on the optics increases, so that simple spherical surfaces can cause noticeable amounts of spherical aberration. If the eye pupil were as large as the entire collimation aperture, then the aimpoint would appear to have a halo blur. Since the eye pupil is typically much smaller than the collimation aperture, the aimpoint appears in sharp focus. But, as the eye decenters in the collimation aperture, the spherical aberration causes an angular deviation to the aimpoint, which is perceived to the eye as parallax.

Examples of prior sights based on the holographic design are U.S. Pat. No. 4,730,912 to Loy et al. and U.S. Pat. No. 5,483,362 to Tai et al. Non-holographic reflex sights are seen in U.S. Pat. No. 4,665,622 to Idan and U.S. Pat. No.

5,373,644 to DePaoli. Both holographic and conventional reflex sights have their limitations.

FIG. 4 is a raytrace layout of a 25.4 mm aperture off-axis F/3.0 reflex sight. Note that the reflector is used off-axis to keep the aimpoint source from obscuring the collimation aperture to the eye. The F/3.0 off-axis reflector has similar adverse aberration properties as an F/1.5 on-axis reflector. The parallax correction of this design is +/−0.1' arc minute on-axis and +/−1.3' off-axis at 0.5 degree.

Enlarging the aperture to 40 mm with the same focal length produces an F/1.9 reflector with a parallax correction of +/−1' on-axis and +/−3' off-axis at 0.5 degree. Enlarging the aperture to 50 mm with the same focal length produces an F/1.5 reflector with a parallax correction of +/−4' on-axis and +/−5 off-axis at 0.5 degree. All of these designs have spherical surfaces, and it seems that the F/1.9 off-axis reflector is the limit for acceptable performance. Note that the distortion of the see-through scene is not quantified, but it will increase as the reflector F/# is reduced. An aspheric off-axis F/1.9 reflector design has the benefit that the non-reflecting surface of the lens can remain flat, so there should be minimal see-through distortion. The F/1.9 aspheric design parallax correction is only slightly better than the F/1.9 spherical design.

The geometrical layout of a tubeless reflex sight provides a good or the required field of view for target acquisition by using an F/1.9 off-axis 40 mm reflector located 228 mm from the eye with the aimpoint source and packaging extending towards the eye 110 mm, which still leaves 100+ mm of mechanical eye relief. This concept works but it can never obtain a super wide field of view. A classical aircraft HUD has the freedom to locate the collimating optics below the dashboard so the aimpoint is combined by a plate beam splitter which has minimal distortion. This arrangement on a firearm almost always leads to an optical sight axis elevated too high above the barrel axis for practical use.

Thus, there remains a need in the art for an improved gunsight with a superwide field of view, good registration of aimpoint with target, minimum aberration parallax, and minimum obstruction of scene view.

SUMMARY OF THE INVENTION

The present invention fulfills this need in the art by providing a sight for a gun including a transparent body having a front, a rear, and peripheral surfaces including a top, a bottom a right side and a left side. A semi-reflective surface within the body extends from the top to the bottom at a diagonal to the front. A light source and reticle negative on a first one of the peripheral surfaces and a collimating mirror for light from the light source and reticle negative on an opposing one of the peripheral surfaces cooperate so that light from a target may pass through the front of the transparent body and exit the rear, and light from the light source may be imaged by the reticle negative, pass through the semi-reflective mirror, be reflected and collimated by the collimating mirror and reflected out of the rear by the semi-reflective mirror as an aimpoint pattern that intermixes with light from the target.

In a preferred embodiment the body is substantially cubic. The peripheral sides are preferably matte and opaque.

The light source and reticle negative may be on the top surface and the collimating mirror on the bottom surface. Alternatively, the light source and reticle negative may be on the bottom surface and the collimating mirror on the top surface.

Preferably, the collimating mirror has an F/# between 0.6 and 2.0. More preferably, the collimating mirror has an F/# of about 0.9. The light source may be a light emitting diode emitting light at a wavelength of about 670 nm or any other visible wavelength. Preferably, the light source, the reticle negative and the collimating mirror cooperate to make an aimpoint pattern including a 30' arc-minute diameter ring having a 4' arc-minute line width.

The transparent body may be glass or a suitable optical material. The body may be a cube having sides about 1 inch (25.4 mm) in length. In an alternate embodiment, the body is a cube having sides about 2 inches (50 mm) in length. Preferably, the body is a cube having sides about 1.2 inch (30 mm) in length.

The semi-reflective mirror typically provides about 60% average transmittance and 30% average reflectance in the visible spectrum.

The reticle negative is preferably bonded to the body to focus the aimpoint at infinity. The collimating mirror is typically a Mangin Mirror bonded to the body. In a preferred embodiment the collimating mirror contacts the body but forms an airgap therewith.

Typically, the sight includes a mount for the body including tilting azimuthal and elevational adjustments. If desired, the sight may include a polarizer for the light source and a polarizing filter oriented to block light from said light source from emanating toward the target.

The invention also provides a sighted gun including a firing mechanism and a barrel to fire a projectile toward a target, and a mount on the barrel supporting a sight. The sight is as above.

The invention also provides a method of aiming a gun with a gunsight including mounting a transparent body having a front, a rear, and peripheral surfaces including a top, a bottom a right side and a left side on top of the gun. Light is directed from a source and through a reticle negative on a first one of the peripheral surfaces and through the body and collimated by reflecting the light from a collimating mirror on an opposing one of the peripheral surfaces. Light from a target is directed through the front of the body and out the rear of the body. The collimated light is reflected from a semi-reflective surface within the body out the rear of the body for registration with the light from the target to form an aimpoint pattern of the image of the reticle negative that intermixes with light from the target to indicate where a shot from the gun would hit.

Preferably, the directing steps include avoiding interfering light coming from the peripheral sides. The collimating step preferably includes introducing very little spherical aberration. The first directing step may include directing light at a wavelength of about 670 nm. The first directing step and the collimating step are preferably performed to make an aimpoint pattern including a 30' arc-minute diameter ring having a 4' arc-minute line width.

The last reflecting step may include transmission of some of the collimated light through a semi-reflective mirror that provides about 60% average transmittance and 30% average reflectance in the visible spectrum.

Preferably, the aimpoint is focused at infinity.

Preferably, the collimating step includes causing the light from the light source to exit the body, transit an airgap and then be reflected by the collimating mirror, re-transit the airgap and re-enter the body.

The system provides a single dot or symbol to the shooter as an aimpoint, at a focus plane which is parallax-free with the targets. The projection plane does not interfere with the shooter's line of vision to the target area. The point of aim is adjustable in windage and elevation. The aimpoint is factory adjustable in size (e.g. 1MOA, 3MOA, etc.) for different shooting situations and target sizes. The aimpoint is adjustable in intensity level to account for different lighting situations. The sighting system will be attached to the firearm and be self contained (e.g. no outboard electronics, headgear, etc.). Weight is less than one pound.

A general consensus developed that a HUD or reflex sight may not be beneficial for the target shotgun application. The potential disadvantage of a reflex sight for clay target shooting is interference with target acquisition.

To maximize the ease of target acquisition, the sight design should have minimal packaging materials around the top, left, and right of the collimation aperture field of view to minimize obscuring the target area. The collimation aperture should be maximized by making it large in diameter and area and locating it close to the eye. Both of these factors equally increase the angular field of view the shooter has of the target area with an aimpoint. The quicker the shooter can acquire the target inside the unrestricted field of view of a collimating aperture where the aimpoint is visible, the better.

The following list of optical parameters forms the preferred optical design requirement for a "Heads-Up Display" (HUD) sighting system tailored to target shotguns.

HUD Optical Parameters

| HUD Optical Parameters | |
|---|---|
| Magnification | Unity 1× |
| Total Scene Field of View | >10 degree H and >7.5 degrees V |
| Collimating Aperture diameter | 30 mm for a 170 mm eye relief<br>40 mm for a 228 mm eye relief<br>50 mm for a 285 mm eye relief |
| Eye Relief | unlimited, distance from the eye to the plane limiting the scene field of view through the collimation aperture |
| Collimator F/# | F/0.6 to F/2.0 for an on-axis collimator |
| Collimator Focus | factory fixed, <+/3' parallax @ 100 m<br><+/−5' parallax @ 30 m |
| Scene Resolution | eye limited |
| Scene Distortion | <10% at the edge of the collimation aperture |
| Scene Transmittance | >50% T visible 450–700 nm |
| Optical Coatings | multilayer dielectric |
| Aimpoint Pattern | 30' arc minute diameter ring<br>4' arc minute diameter line width |
| Aimpoint Brightness | >2000 Ft-L at maximum with a 10 position brightness control |
| Aimpoint Adjustment | Tilting mechanism for windage and elevation +/−45' arc minute adjustment range<br><1' arc minute adjustment resolution |
| Aimpoint Light Source | LED, Red at 670 nm wavelength for maximum scene transmission coatings or other colors for improved contrast with target |

Others can be used as will be apparent. The sight could be optimized differently for other shooting sports.

BRIEF DESCRIPTION OF THE DRAWINGS

The invention will be better understood after a reading of the Detailed Description of the Preferred Embodiment and a review of the drawings, in which.

DETAILED DESCRIPTION OF THE PREFERRED EMBODIMENT

The present optical design concept allows the combiner plane to be close to the eye without the aimpoint source being significantly closer and takes advantage of using collimating optics on-axis, where the aberrations are more correctable for a low F/# design.

Figure 1:
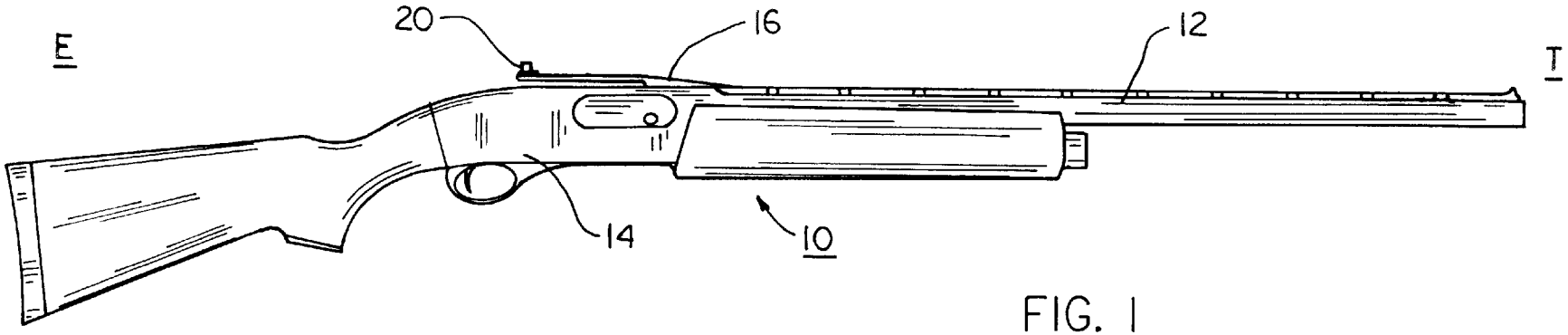
FIG. 1 is a perspective view of a shotgun equipped with the sight of the present invention.

As seen in FIG. 1, a gun, such as a shotgun 10, is made up of a conventional barrel 12 and receiver 14 as well as other conventional gun components. While this invention is particularly well-suited for use with a shotgun, it is understood that other types of guns, such as handguns and rifles may be suitable. The sight of the present invention is not intended for use on military artillery or the like. However, the sight may well have practical use on military small arms, such as less than .50 caliber. The gun 10 may be provided with a conventional cantilevered mount 16, such as the cantilevered mount that is currently sold by Remington Arms Co., Inc. of Madison, N.C. Or the mount could be of a different size to get closer to the eye to take advantage of the closer eye relief features. Other conventional mounts can be used.

Figure 2:
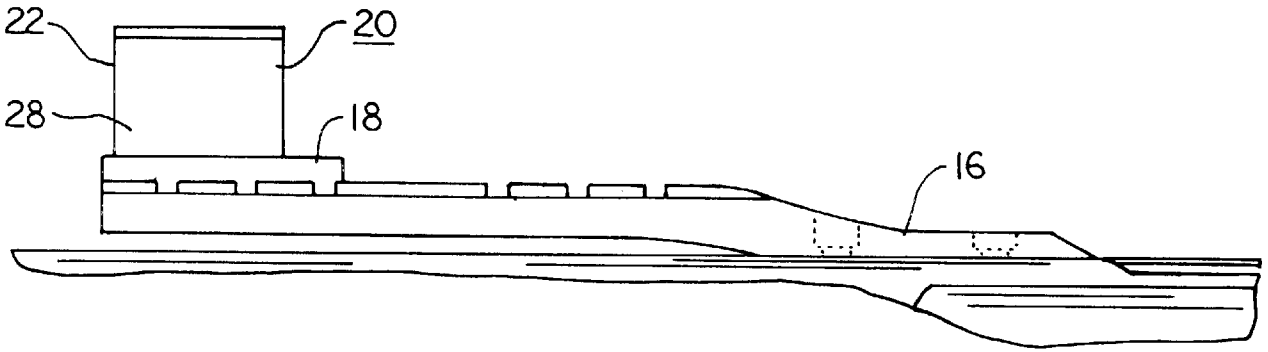
FIG. 2 is an enlarged, side view of the sight located on a mount.

Referring now to FIG. 2, an enlarged view of the sight apparatus can be seen, with the mount 16 affixed to the barrel 12. A base 18 is factory bonded to the sighting cube 20. The base should be provided with mechanisms to provide an azimuthal and elevational tilting to the sight 20 mounted on the mount 16 in conventional fashion to allow the sight to be zeroed for the particular gun to which it is mounted. The base 18 can house, not only the zeroing mechanism, but also a battery power supply and appropriate switches, including possible LED intensity switches for a light source of the sight. The base can have a Weaver-style mount or a conventional cantilever mount.

The details of the power supply are not critical to this invention; an arrangement as shown in U.S. Pat. No. 5,369,888 to Kay may be suitable. In addition, the DePaoli patent referred to above also includes disclosure of a potentially useful power supply arrangement.

Figure 3:
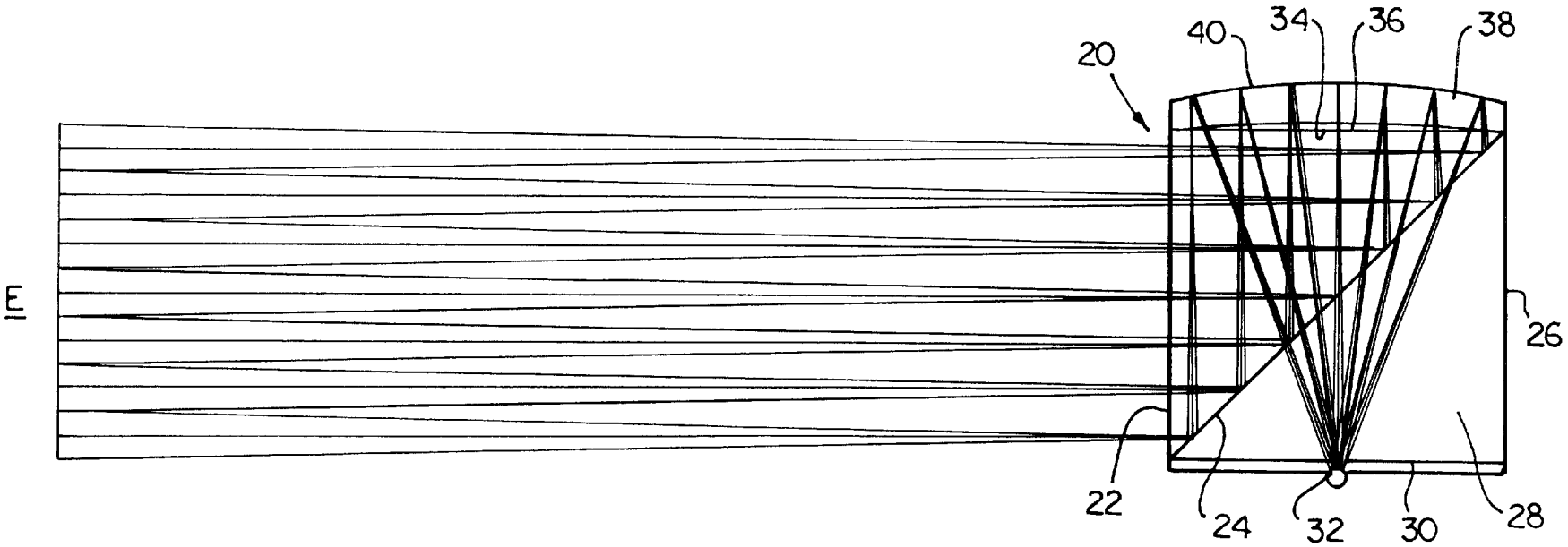
FIG. 3 is a schematic raytrace of the sight optical design.
Figure 4:
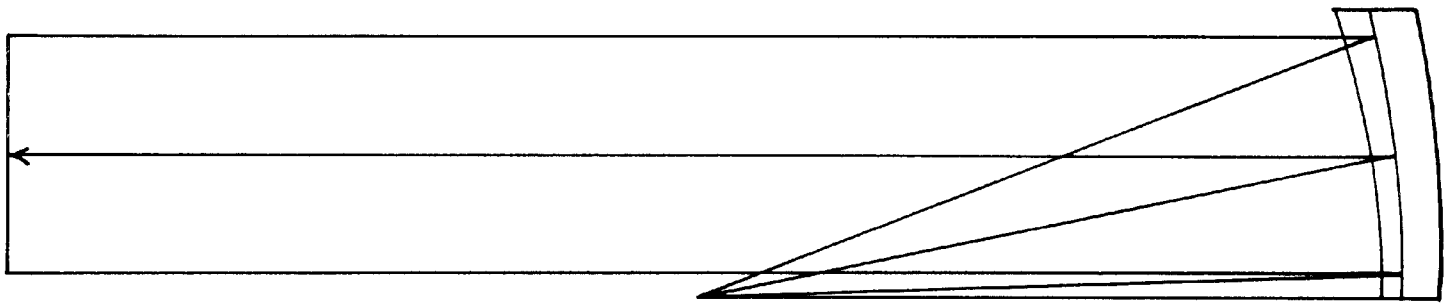
FIG. 4 PRIOR ART
FIG. 4 is a schematic raytrace of a prior art off-axis reflex sight.

An optical glass cube 20 is the foundation for the cube sight, providing a collimation path for the aimpoint. The cube is preferably BK7 optical glass with a 30 mm side dimension. The user's eye looks into one face 22 and sees an aimpoint symbol superimposed on the through-scene of the target area. As seen in FIG. 3, the cube has an internal 45 degree fold optical surface 24 which acts a beam combiner for the aimpoint and scene. The cube beam combiner surface 24 is coated with a semi-mirrored optical coating which provides 60% average transmittance and 30% average reflectance in the visible spectrum. The coating design may be varied for wavelength and polarization to increase transmittance efficiency for the aimpoint and scene. The cube external surfaces 22 and 26 for the see-through path are antireflection coated and the left and right sides 28 and top are roughened and blackened for stray light attenuation. Thus, they are matte and opaque.

The aimpoint is projected from the bottom side of the cube. A negative reticle pattern 30 is bonded to the bottom surface of the cube with a precise process to factory focus the aimpoint at infinity for zero parallax error. The aimpoint reticle is illuminated from the rear with a light emitting diode, LED 32, or an alternate light source.

The light rays emanate from the aimpoint reticle divergent up through the cube and first impact the beam combiner surface 24. Some of the light energy is reflected 90 degrees towards the target area, but the majority continues upward in the cube. To minimize this unwanted scene illumination at the first pass of the beam combiner, a polarization technique can be implemented. This can be accomplished if the aimpoint light source 32 is polarized (such as by interposition of a polarizer before the reticle pattern 30) and an optical quarter wave plate inserted at the surface 34 of the cube. As the light reaches the top surface 34 of the cube, it refracts out of the cube and after a small air gap 36 then into a concave element 38. This element 38 is a Mangin mirror and is the only element in the sight which has optical collimating power. The Mangin mirror 38 and negative reticle pattern 30 are also preferably BK7 glass. Other suitable materials can be used. The material preferably is the same as for the cube to prevent differential thermal expansion problems. The light reflects off of the top surface 40 of the element and then travels back through the element 38, through the air gap 36, and down into the cube 20. The reflecting surface 40 of the Mangin mirror 38 is optically coated for high reflectance. The Mangin mirror is bonded onto the top surface of the cube before the aimpoint reticle pattern 30 is positioned for final focus.

As the light rays reach the beam combiner surface 24 for the second time, a collimated aimpoint is projected towards the eye E with 17% transmittance efficiency, assuming a 60% T, 30% R cube coating. The sight optical efficiency provides 60% to the scene and 17% to the aimpoint.

A 30 mm cube sight 20 provides a 26 mm collimation aperture for the aimpoint. The sight is a F/0.9 on-axis collimator with all spherical and flat optical surfaces. The cube dimensions and collimation apertures are scaleable to any required dimension. The sight design has a ray-traced collimation performance of less than +/−2' arc minute parallax on-axis and less than +/−5' arc minute parallax at +/−1 degree off-axis. At F/0.9, the design is hyper-focus sensitive, and it is for this reason that the cube 20, Mangin element 38, and aimpoint reticle 30 should all be made of the same type of optical glass material and bonded together to control aimpoint parallax. As an example, if the aimpoint reticle or the Mangin element moves 14 microns (0.0006 inch), then the aimpoint gets a +/−1' arc minute parallax error. This is typically nine times more sensitive than existing F/3 commercial sights. A thermal temperature shift of 30 degrees C on the BK7 glass material can almost cause a 1' arc minute parallax error. Preferably, the aimpoint circle is sized to be about the apparent size of the target at the expected firing distance. Thus, if the target fills the aimpoint, a good aim is indicated. This is particularly useful for clay targets used in skeet and trap shooting.

The sight of the invention can be located on a gun relatively close to the eye for a maximum view through the sight, since there need not be space between the eye and the sight for the light source.

The sight design can satisfy all of the HUD optical design requirements as previously listed. The design is truly a super wide field of view sight which can not only match this advantage of a holographic sight but achieves it in a fraction of the volume.

Those of ordinary skill in the art will appreciate that variations in the structure specifically disclosed herein can be adopted and still fall within the scope of this invention.

What is claimed is:

1. A sight for a gun comprising a transparent body having a front, a rear, and peripheral surfaces including a top, a bottom a right side and a left side, a semi-reflective surface within said body extending from said top to said bottom at a diagonal to said front, a light source and reticle negative on a first one of said peripheral surfaces and a collimating mirror for light from said light source and reticle negative on an opposing one of said peripheral surfaces, whereby light from a target may pass through said front of said transparent body and exit said rear, and light from said light source may be imaged by said reticle negative, pass through said semi-reflective surface, be reflected and collimated by said collimating mirror and reflected out of said rear by said semi-reflective surface as an aimpoint pattern that intermixes with light from said target.

2. A sight as claimed in claim 1 wherein said body is substantially cubic.

3. A sight as claimed in claim 1 wherein said peripheral sides are matte and opaque.

4. A sight as claimed in claim 1 wherein said a light source and reticle negative are on said bottom surface and said collimating mirror is on said top surface.

5. A sight as claimed in claim 1 wherein said a light source and reticle negative are on said top surface and said collimating mirror is on said bottom surface.

6. A sight as claimed in claim 1 wherein said collimating mirror has an F/# between 0.6 and 2.0.

7. A sight as claimed in claim 1 wherein said collimating mirror has an F/# of about 0.9.

8. A sight as claimed in claim 1 wherein said peripheral sides are matte, opaque and dark.

9. A sight as claimed in claim 1 wherein said light source, said reticle negative and collimating mirror cooperate to make an aimpoint pattern comprising a 30' arc-minute diameter ring having a 4' arc-minute line width.

10. A sight as claimed in claim 1 wherein said body is cube having sides about 1 inch (25.4 mm) in length.

11. A sight as claimed in claim 1 wherein said body is cube having sides about 2 inches (50 mm) in length.

12. A sight as claimed in claim 1 wherein said body is cube having sides about 1.2 inch (30 mm) in length.

13. A sight as claimed in claim 1 wherein said semi-reflective surface provides about 60% average transmittance and 30% average reflectance in the visible spectrum.

14. A sight as claimed in claim 1 wherein the reticle negative is bonded to the body to focus the aimpoint at infinity.

15. A sight as claimed in claim 1 wherein said collimating mirror is a Mangin Mirror.

16. A sight as claimed in claim 1 wherein said collimating mirror is a Mangin Mirror bonded to said body.

17. A sight as claimed in claim 1 wherein said collimating mirror contacts said body but forms an airgap therewith.

18. A sight as claimed in claim 1 further comprising a base for said body, said base having tilting azimuthal and elevational adjustments.

19. A sight as claimed in claim 1 further comprising a polarizer for said light source and a polarizing filter oriented to block light from said light source from emanating toward the target.

20. A sight as claimed in claim 1 wherein said transparent body is glass.

21. A sight as claimed in claim 20 wherein said body is BK7 glass.

22. A sight as claimed in claim 1 wherein said transparent body is crystalline.

23. A sight as claimed in claim 22 wherein said body is silicon dioxide.

24. A sight as claimed in claim 1 wherein said transparent body is plastic.

25. A sight as claimed in claim 20 wherein said body is acrylic.

26. A sight as claimed in claim 1 wherein magnification of the target seen through the sight is unity.

27. A sight as claimed in claim 1 wherein the collimating mirror F/# is F/1.0 for an on-axis collimator.

28. A sight as claimed in claim 1 wherein said collimating mirror has a set focus with less than +/−3' parallax at 100 meters.

29. A sight as claimed in claim 1 wherein said collimating mirror has a set focus with less than +/−5' parallax at 30 meters.

30. A sight as claimed in claim 1 wherein the body forms a collimation aperture for viewing the target and scene distortion is less than 10% at the edge of the collimation aperture.

31. A sight as claimed in claim 1 wherein scene transmittance through the body is greater than 50% in the visible wavelengths from 450–700 nm.

32. A sight as claimed in claim 1 wherein the body has an optical coating of a multi-layer dielectric.

33. A sight as claimed in claim 1 wherein the aimpoint pattern includes a 30' arc minute diameter ring.

34. A sight as claimed in claim 33 wherein the ring has a 4' arc minute diameter line width.

35. A sight as claimed in claim 1 wherein the aimpoint pattern has a brightness of at least 2000 Ft-L.

36. A sight as claimed in claim 1 wherein the aimpoint pattern includes a ring sized to be about the size of the target at the expected firing distance.

37. A sighted gun comprising a) a firing mechanism and a barrel to fire a projectile toward a target, and b) a mount on said barrel, said mount supporting a sight, said sight including:

i) a transparent body having a front, a rear, and peripheral surfaces including a top, a bottom a right side and a left side, ii) a semi-reflective surface within said body extending from said top to said bottom at a diagonal to said front, iii) a light source and reticle negative on a first one of said peripheral surfaces and a collimating mirror for light from said light source and reticle negative on an opposing one of said peripheral surfaces, iv) whereby light from a target may pass through said front of said transparent body and exit said rear, and light from said light source may be imaged by said reticle negative, pass through said semi-reflective mirror, be reflected and collimated by said collimating mirror and reflected out of said rear by said semi-reflective mirror as an aimpoint pattern that intermixes with light from said target to assist a shooter in aiming the gun.

38. A sighted gun as claimed in claim 37 wherein said body is mounted on said gun to provide a total scene field of view greater than 10 degrees horizontally.

39. A sighted gun as claimed in claim 37 wherein said body is mounted on said gun to provide a total scene field of view greater than 7.5 degrees vertically.

40. A sight for a gun comprising a transparent, substantially cubic, glass body having a front, a rear, and peripheral surfaces including a top, a bottom, a right side and a left side which are opaque and matte, a semi-reflective surface within said body extending from said top to said bottom at a diagonal to said front, a light emitting diode and reticle negative on a said bottom surface and a collimating mirror with an F/# between 0.6 and 2.0 for light from said light source and reticle negative on said top surface contacting said body but forming an airgap therewith, whereby light from a target may pass through said front of said transparent body and exit said rear, and light from said light source may be imaged by said reticle negative, pass through said semi-reflective mirror, be reflected and collimated by said collimating mirror and reflected out of said rear by said semi-reflective mirror as an aimpoint pattern that intermixes with light from said target and said light source, said reticle negative and collimating mirror cooperate to make an aimpoint pattern comprising a 30' arc-minute diameter ring having a 4' arc-minute line width focussed at infinity.

41. A sight as claimed in claim 40 wherein said collimating mirror has an F/# of about 0.9.

42. A method of aiming a gun with a gunsight comprising mounting a transparent body having a front, a rear, and peripheral surfaces including a top, a bottom a right side and a left side on top of the gun, directing light from a source and through a reticle negative on a first one of the peripheral surfaces and through the body, collimating the light from the light source by reflecting the light from a collimating mirror on an opposing one of the peripheral surfaces, directing light from a target through the front of the body and out the rear of the body, and reflecting the collimated light from a semi-reflective surface within the body out the rear of the body for registration with the light from the target to form an aimpoint pattern of the image of the reticle negative that intermixes with light from the target to indicate where a shot from the gun would hit including transmission of some of the collimated light through a semi-reflective mirror that provides about 60% average transmittance and 30% average reflectance in the visible spectrum.

43. A method as claimed in claim 42 wherein said directing steps include avoiding interfering light coming from the peripheral sides.

44. A method as claimed in claim 42 wherein said collimating step includes introducing very little spherical aberration.

45. A method as claimed in claim 42 wherein said first directing step includes directing light at a wavelength in the range of 400–1000 nm.

46. A method as claimed in claim 42 wherein said first directing step and said collimating step are performed to make an aimpoint pattern comprising a 30' arc-minute diameter ring having a 4' arc-minute line width.

47. A method as claimed in claim 42 wherein the aimpoint is focused at infinity.

48. A method of aiming a gun with a gunsight comprising mounting a transparent body having a front, a rear, and peripheral surfaces including a top, a bottom a right side and a left side on top of the gun, directing light from a source and through a reticle negative on a first one of the peripheral surfaces and through the body, collimating the light from the light source by reflecting the light from a collimating mirror on an opposing one of the peripheral surfaces, including causing the light from the light source to exit the body, transit an airgap and then be reflected by the collimating mirror, re-transit the airgap and re-enter the body, directing light from a target through the front of the body and out the rear of the body, and reflecting the collimated light from a semi-reflective surface within the body out the rear of the body for registration with the light from the target to form an aimpoint pattern of the image of the reticle negative that intermixes with light from the target to indicate where a shot from the gun would hit.

49. A method of aiming a gun with a gunsight comprising mounting a transparent body having a front, a rear, and peripheral surfaces including a top, a bottom a right side and a left side on top of the gun, directing light from a source through a reticle negative on a first one of the peripheral surfaces and through the body, collimating the light from the light source by causing the light from the light source to exit the body, transit an airgap and then be reflected by a collimating mirror, re-transit the airgap and re-enter the body reflecting the light from the collimating mirror on an opposing one of the peripheral surfaces while introducing very little spherical aberration, directing light from a target through the front of the body and out the rear of the body and avoiding interfering light coming from the peripheral sides, and reflecting the collimated light through a semi-reflective mirror that provides about 60% average transmittance and 30% average reflectance in the visible spectrum within the body out the rear of the body for registration with the light from the target to form an aimpoint pattern of the image of the reticle negative comprising a 30' arc-minute diameter ring having a 4' arc-minute line width focused at infinity that intermixes with light from the target to indicate where a shot from the gun would hit to make an aimpoint pattern.

* * * * *